US005813554A

United States Patent [19]

Marangoni Graziani et al.

[11] Patent Number: 5,813,554

[45] Date of Patent: Sep. 29, 1998

[54] ANNULAR LOCK

[75] Inventors: Antonio Marangoni Graziani, Barcelona; José Luis Gómez Cao, Molins de Rei, both of Spain

[73] Assignee: Diseño Industrial Mago, S.L., Barcelona, Spain

[21] Appl. No.: 713,802

[22] Filed: Sep. 13, 1996

[51] Int. Cl.[6] ..... B65D 45/30

[52] U.S. Cl. ..... 215/274; 215/364; 220/254; 220/319

[58] Field of Search ..... 215/274, 273, 215/277, 276, 253, 364; 220/254, 319

[56] References Cited

U.S. PATENT DOCUMENTS

| | | | |
|---|---|---|---|
| 3,630,404 | 12/1971 | Guala | 215/277 X |
| 3,838,785 | 10/1974 | Lancesseur | 215/277 X |
| 4,456,143 | 6/1984 | Davis et al. | 215/274 X |
| 4,512,487 | 4/1985 | Augros | 215/274 |
| 5,085,332 | 2/1992 | Gettig et al. | 215/274 X |
| 5,314,084 | 5/1994 | Folta et al. | 215/274 X |
| 5,522,518 | 6/1996 | Konrad et al. | 215/274 X |

*Primary Examiner*—Jes F. Pascua
*Attorney, Agent, or Firm*—Klauber & Jackson

[57] ABSTRACT

An annular lock stopper for closing an aperture of a bottle having a neck with an inner wall, an upper edge which delimits the aperture, and an outer recess situated below the upper edge on an outer wall. The annular lock stopper includes a stopper part and a ring part. The stopper part includes a central stem for insertion into the neck of the bottle, an upper part, fixed to the central stem, and an outer part, depending from the upper part and arranged to embrace the outer surface of the neck of the bottle when the stopper part is in the inserted position, the outer part having a lower end portion comprising a widening arranged to fit into the outer recess of the neck of the bottle when the stopper part is in the inserted position. The ring part is attached to the stopper part by frangible connection disposed between a lower portion of the ring part and an upper portion of the stopper part, the ring part having an inner diameter such that, once the stopper part is in the inserted position and once the frangible connection means is broken, the ring part is displaceable in a first direction to a closed position in which the ring part surrounds and embraces the outer part of the stopper part.

10 Claims, 4 Drawing Sheets

ANNULAR LOCK

FIELD OF THE INVENTION

As is expressed by the statement of this descriptive report, the present invention consists of a lock assembly basically made up of a stopper which locks an aperture or mouth of a bottle, a hood or ring which surrounds the stopper perimetrically, is conveniently coupled on the upper part of the same, and which, by means of threads or small channels performed on the inside part of the valve cap which exactly match with those carried out on the head of the stopper, allow longitudinal displacement in such a manner, that said ring acquires two positions, one which frees the blocking of the stopper and the other which fits it with complete accuracy and safety against the walls of the bottle or aperture to be closed.

BACKGROUND OF THE INVENTION

At present, an endless number of stoppers can be found in the Market, which cover other such functions and requirements. The manufacturers intend to solve the demands of the packers, and this is not difficult to achieve, as long as it deals with products without important alterations, but when transformation or precision elements are involved, such as is the case of sparkling wines or pressurized products, the lock constitutes a problem which is not easy to solve.

Traditionally, attachment systems are applied, such as a metallic spring which ties down the stopper to the neck of the bottle or container, or a sealant such as plastic, silicone or even a welding band is applied, according to the safety requirements against accidental aperture or opening.

Generally, these systems, in greater or lesser degree, as one or other value prevails, raise the price of the production of the product, complicate the manufacturing or requiring complementary accessories at the moment of handling the same.

Additionally, in the case of sparkling wine, the greater part of the locks are comprised of two parts: one, the plastic stopper and the other, a metallic part which blocks the stopper to the bottle neck. The disadvantage presented by this system is that, due to humidity and to the time during which the product must remain inside the wine cellar for aging, the ferreous material may oxidize, causing endless problems.

Likewise, in this same case, for example during the fermenting of sparkling wines, the handling of the uncorking is carried out manually or semimanually, in traditional wine cellars which sometimes require an important physical effort and which results hindered whenever it requires accessory instruments.

Moreover, the bottles are subjected to various ambient pressures by the effect of the gas, and all complications during the opening, even if it does not involve greater hazard, does at least demand greater care.

SUMMARY OF THE INVENTION

In order to solve the previously indicated disadvantages, —they offer greater simplicity to the lock, greater facility in the aperture or locking of the same, much greater safety and sealing assurance,—the present invention consists of an assembly forming a lock and which is characterized in that is comprises a cylindrically shaped stopper, preferably manufactured in plastic, and which, by means of the novelty of an assembly of elements placed on the upper part, is going to allow an original, simple and safe lock. The stopper is made up in turn of various sections of greater diameter and on the upper part it ends in the shape of a valve cap or hood throughout all its contour on which the mecanism is articulated, achieving, by means of different positions, the pretended effect.

To be better understood, the actual stopper may be divided into three sections. The first is made up of a cylindrical stem which is inserted into the mouth of the bottle or container, characterized by a diameter which is adaptable to the section of the bottle or container mouth and with a length of various centimeters. On its exterior walls, it presents various webs throughout all the perimeter which confer a greater fit to the walls of the container, and on the upper part it opens its radius and configurates an inverted "U"-shaped rim, in such a manner that is adapts to the edges of the container mouth and the exterior leg of the "U" serves as a stop. It has additionally, a slight inclination or protuberance towards the center of the stopper, the object being to adapt with greater accuracy due to bending of the material, to the neck presented by the containers as an aesthetic finish and functional objective for a better attachment of the stoppers.

The second section is superimposed on the previously indicated section and is a continuation of the stopper, though having a larger diameter than the central stem, empty in its interior to the same section as the stem with only the lateral walls forming a ring, attached to the stem by its lower profile and only by discontinuous attachment points, in the manner of a flange or stud. These very weak connection points allow, once the base stopper or main stem has totally penetrated inside the bottle neck up to its stop in "U", that the upper ring be pushed onto the projection line of the stopper, breaks the connection lugs, descends progressively parallel and adjusts to the external walls of the "U" of the stopper, finally embracing it all around the container neck. Thus, once the crown or upper ring has totally descended to the level of the main stem, it forms a seal or a band completely around the mouth, which makes the external leg of the "U" unable to be disposed, until the ring returns for displacement in the opposite direction, or frees the leg of the "U" trapped as a sandwich in the neck of the container. The third section is a slight variation which completes the previous two in order that it couples better to other containers or allows various opening operations to the lock, instead of one single use as in the previous one.

Basically, it is the same configuration as has already been described, but the variation is focused on the main stem, which is hollow and the end of its upper part is threaded in such a manner that another stopper may be produced permitting the partial opening of the container without requiring the removal of all the locking assembly as in the previous cases, being able to close or open with greater facility, as many times as desired.

The thread is carried out on the upper part of the central stopper stem. Another counter threaded stopper, manually locks the tube as long as the safety ring is in its blocking position. In this way, all the locking mechanism offers total safety, and on the other hand, assures that the lock has not been handled, due to the fact that the ring may be removeable or not.

BRIEF DESCRIPTION OF THE DRAWINGS

In order to offer a better understanding of the descriptive report, and forming integral part of the same, a series of drawings are enclosed, in which, with illustrative, non limitative character, the structure and object of the invention has been presented.

DESCRIPTION OF THE PREFERRED EMBODIMENTS

In order to be better understood, a description of the invention is herewith offered, based on a practical application of the abovementioned drawings.

Figure 1:
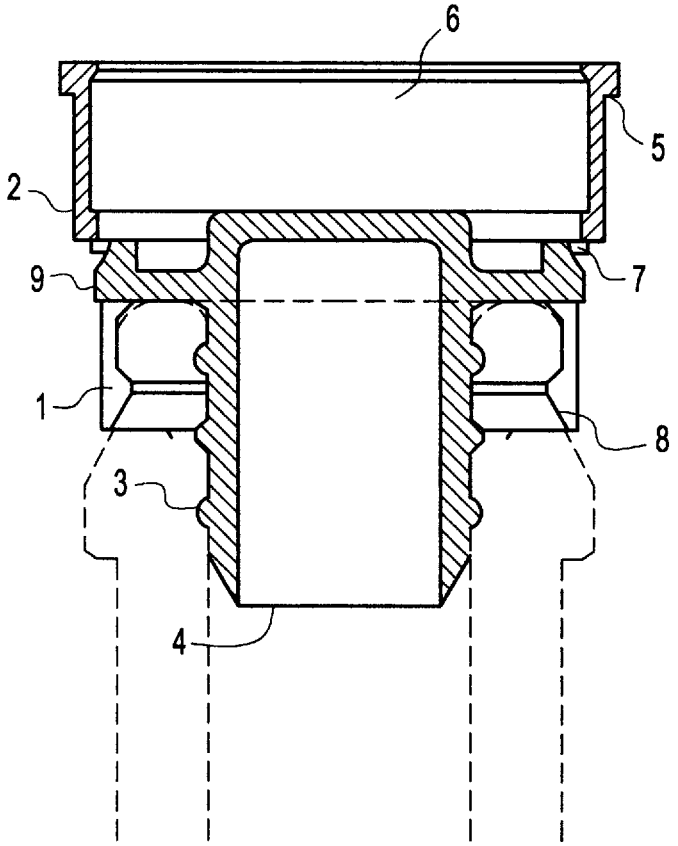
FIG. 1 shows a sectional view of all the locking assembly, both of the stopper, already inserted in the mouth of the bottle, and prior to lowering the upper ring for blocking the main stem lugs, as well as the upper and lower view of the ring.

As is detailed in FIG. 1, the invention consists of a main stem or stopper (4), of cylindrical shape, having various protuberances, sealing rings, or webs (3) performed on its walls, which permit, on the one hand, an easier displacement, and on the other hand, a greater sealing quality. In the upper part it presents in the first place, a cap part or widening in the form of a flange or tabs (9) which serve as stop to the edge of the bottle mouth and simultaneously descends in the shape of an inverted "U" (1) adjusting to the configuration of the container neck in the shape of a flap or lug which widens at its end and is housed with the neck of the bottle. In one embodiment, these flaps are placed all around the bottle mouth and form a type of discontinuous belt to facilitate the bending of the material and allow the flaps to reach the recess of the mouth or neck of the bottle (8). The upper part of the stopper forms a ring (6), the base of which is on the same level as the upper part of the trunck of the stopper or central stem and is attached by means of very weak flanges (7) in the way of welding points which are easily crowned once the ring is pushed and displaced towards the trunck of the stopper, and which, once displaced, allows the maximum safety locking. The ring is equipped, on the lower part of its wall, with a slight rim (2) which, when displaced towards the trunck of the stopper, will go round the tab (9) by pressure and will penetrate in the zone of the recess (8) with precision fit, configuring a belt all around the bottle, and will impede the lug (1) to exit from its fit if the ring (6) is not once again previously freed. The flange (9) ensures that once the ring (6) has been placed in contact with the lug (1), the same does not accidentally exit. The ring will only be displaced towards the exterior, exerting sufficient strength to overcome the stop (9). For greater facility at the moment of freeing the ring, the same has been provided with another flange or rim (5) on the upper part of the external wall, allowing that either by hand or during an automatic process, the ring may be attached and separated from all the system, and from there, facilitate the aperture and opening of the stopper assembly.

Figure 2:
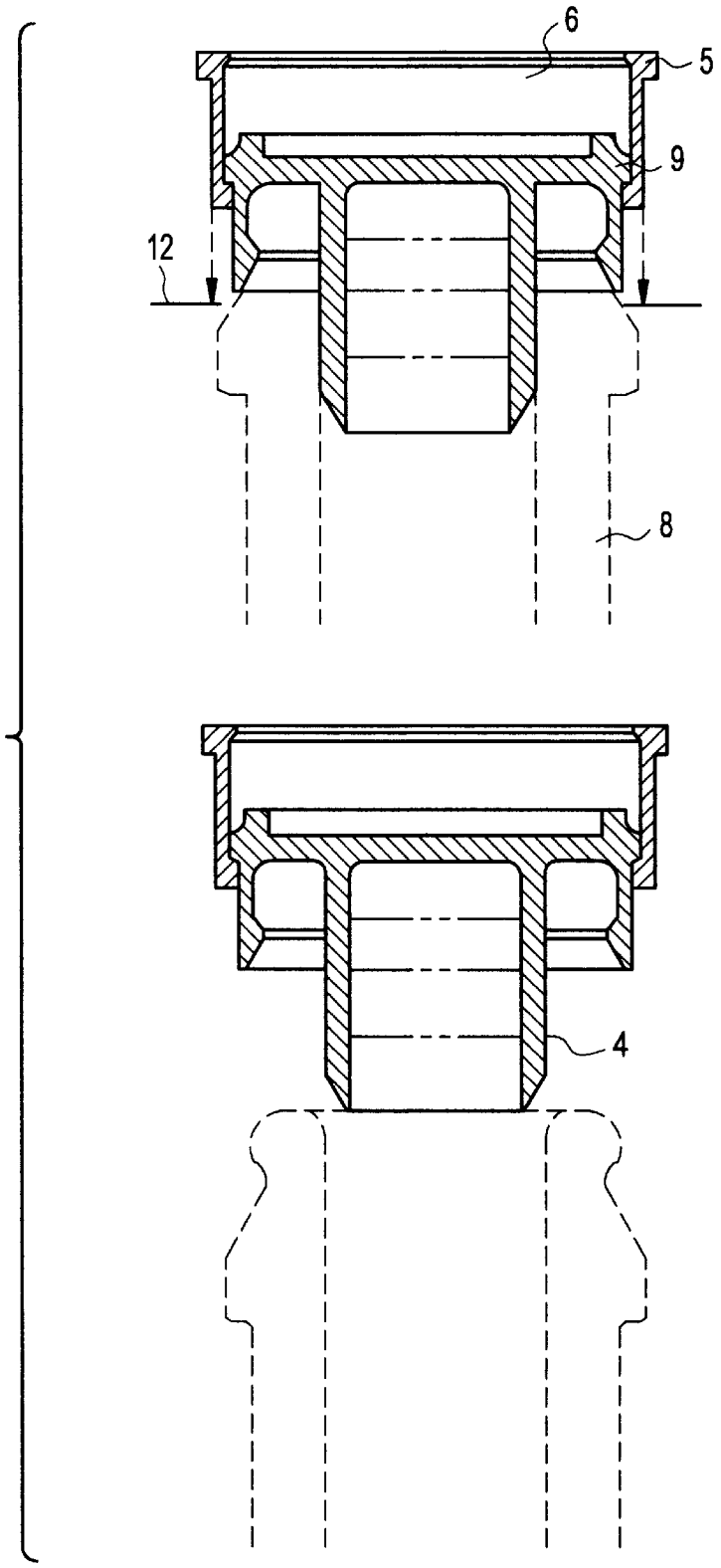
FIG. 2 shows a view prior to inserting the stopper in the bottle neck and once already having been inserted, reaching its stop and adjusting the rim to the recess of the bottle mouth.

In FIG. 2, two different movements of the same system may be observed. In the lower part a moment is shown, in which all the system is confronted in order to insert in the first place, the central stem (4) in the bottle neck. In the upper part, the stopper can already be seen fitted in its final position, and at last, as a last step, the ring (6) shall be pressed in the same direction as the entrance of the stopper until the stop is reached, and shall be situated at level 12, notch fitted into notch.

Figure 3:
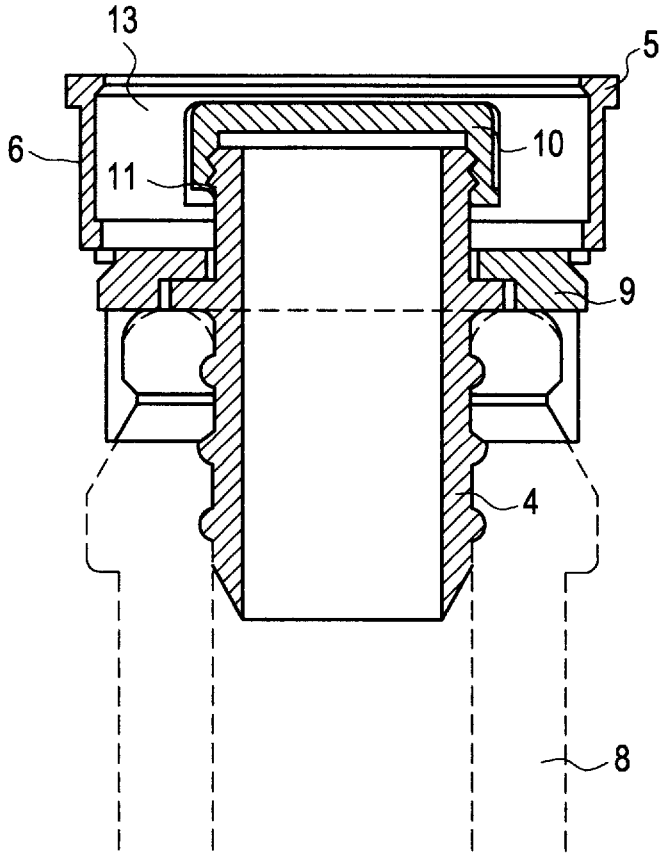
FIG. 3 shows the variation on the previous development in which may also be observed the threading system for the insertion of the independent over-stopper of the locking assembly and which operates according to the wishes of the user, without requiring the removal of all the assembly.

FIG. 3 represents the same system which considers a variation as regards adapting to different production processes, and said variation specifically involves the fact that the main stem (4) is hollow, that in its upper trunck it is equipped with a thread (11), that it couples with the one carried out inside the over-stopper (13) which permits the removal when desired, independently from the structure of the assembly and access to the contents in the container. Ring (6) is displaced as has been previously described, attaching all the assembly to the mouth of the container, and conferring safety and guarantee to the assembly.

The innovation specified and recommended in this report, within its essentiality, can be put into practice with other forms of embodiments, materials and sizes, which are also covered by the protection which is claimed in this model, and which do not alter the scope of the claims.

Figure 4:
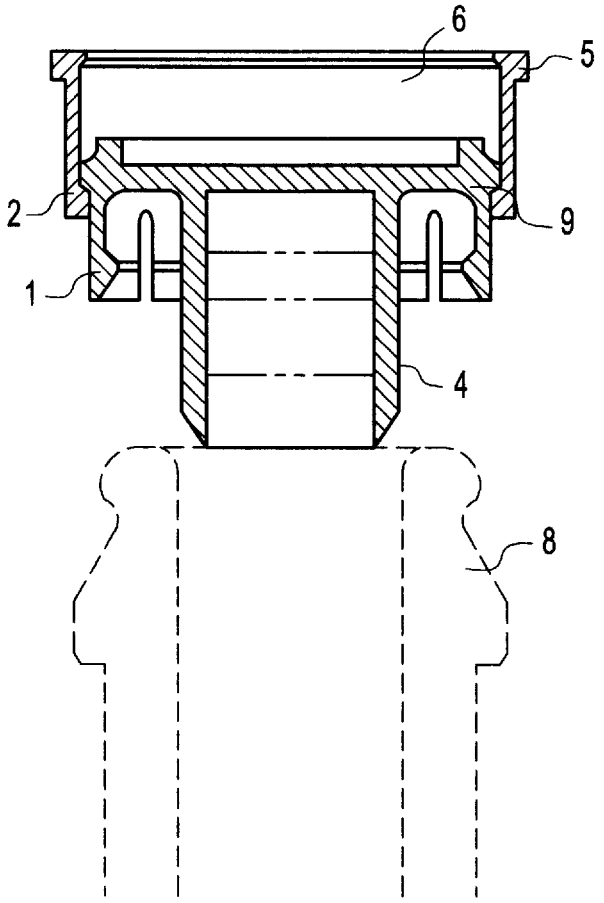
FIG. 4 shows another embodiment of the present invention, similar to that shown in FIG. 2, and further showing an outer part of the stopper part having a plurality of flaps.

FIG. 4 shows another embodiment of the present invention, similar to that shown in FIG. 2, and further showing an outer part of the stopper part having a plurality of flaps.

What is claimed is:

1. An annular lock stopper for closing an aperture of a bottle having a neck with an inner wall, an upper edge which delimits the aperture, and an outer recess (8) situated below said upper edge on an outer wall, the annular lock stopper comprising:

a stopper part comprising:

a central stem (4) for insertion into the neck of the bottle, said central stem having an outer wall with sealing rings (3) for providing sealing between the outer wall and the inner wall of the neck of the bottle;

an upper part, fixed to said central stem (4), said upper part including a cap part (9) comprising an abutment surface for abutting against the upper edge of the bottle when said stopper part is in an inserted position in which said central stem (4) is disposed inside the neck of the bottle; and an outer part, depending from said upper part and arranged to embrace the outer surface of the neck of the bottle when said stopper part is in the inserted position, said outer part having a lower end portion comprising a widening arranged to fit into the outer recess (8) of the neck of the bottle when said stopper part is in said inserted position; and a ring part (6) attached to said stopper part by frangible connection means (7) disposed between a lower portion of said ring part and an upper portion of said stopper part, said ring part having an inner diameter such that, once said stopper part is in the inserted position and once said frangible connection means is broken, said ring part is displaceable in a first direction to a closed position in which said ring part surrounds and embraces the outer part of said stopper part, said ring part having a lower inner flange (2) disposed below the lower end portion of said outer part of said stopper part in the closed position, in order to block said ring part so as to prevent accidental displacement of said ring part from the closed position.

2. The annular lock stopper according to claim 1 wherein the outer part of said stopper part comprises a plurality of flaps.

3. The annular lock stopper according to claim 1 wherein the outer part of said stopper part defines a sleeve having a height of approximately 1 cm.

4. The annular lock stopper according to claim 1 wherein said central stem (4) has a length of at least one centimeter.

5. The annular lock stopper according to claim 1 wherein said stopper part, said ring part and said frangible connection means are formed from a plastic material in an injection mold into a single unitary piece.

6. The annular lock stopper according to claim 1 wherein said ring part is hollow.

7. The annular lock stopper according to claim 1 wherein said ring part further comprises an upper inner flange in order to additionally secure said ring part to an upper end portion of said outer part in the closed position.

8. The annular lock stopper according to claim 1 wherein said ring part further comprises an upper outer flange (5) in order to facilitate displacement of said ring part in a second direction, opposite to the first direction, from the closed position to an opened position.

9. The annular lock stopper according to claim 1 wherein the outer part of said stopper part has a substantially vertical outer surface.

10. The annular lock stopper according to any of the preceding claims further comprising an over-stopper, wherein said central stem is hollow and wherein the upper part of said stopper part comprises a threaded portion (11) onto which said over-stopper can be applied.

* * * * *